US006380896B1

(12) United States Patent
Berger et al.

(10) Patent No.: US 6,380,896 B1
(45) Date of Patent: Apr. 30, 2002

(54) CIRCULAR POLARIZATION ANTENNA FOR WIRELESS COMMUNICATION SYSTEM

(75) Inventors: H. Stephen Berger, Georgetown; Paulus Sastrodjojo, Round Rock; Donna Lakomski, Austin; Ivan G. Stepanov, Round Rock, all of TX (US)

(73) Assignee: Siemens Information and Communication Mobile, LLC, San Diego, CA (US)

( * ) Notice: Subject to any disclaimer, the term of this patent is extended or adjusted under 35 U.S.C. 154(b) by 0 days.

(21) Appl. No.: 09/703,977

(22) Filed: Oct. 30, 2000

(51) Int. Cl.[7] ..... H01Q 1/38
(52) U.S. Cl. ..... 343/700 MS; 343/850; 343/853

(58) Field of Search ..... 343/700 MS, 853, 343/850, 895, 702, 820, 821, 822; H01Q 1/38

(56) References Cited

U.S. PATENT DOCUMENTS

| | | | | |
|---|---|---|---|---|
| 5,223,848 A | * | 6/1993 | Rammos et al. | 343/700 MS |
| 5,786,793 A | * | 7/1998 | Maeda et al. | 343/700 MS |
| 6,252,551 B1 | * | 6/2001 | Noro et al. | 343/700 MS |

* cited by examiner

*Primary Examiner*—Hoanganh Le

(57) ABSTRACT

An antenna system for a wireless communication system. The system includes an antenna configured to receive and transmit circular polarized transmissions and a drive system. The drive system is operable to produce at least two outputs having generally the same amplitude and an appropriate relative phase difference so as to create a circular polarization transmission from the antenna.

33 Claims, 11 Drawing Sheets

CIRCULAR POLARIZATION ANTENNA FOR WIRELESS COMMUNICATION SYSTEM

FIELD OF THE INVENTION

The present invention relates generally to communication systems, and more specifically, to a communication system utilizing a circular polarization antenna.

BACKGROUND OF THE INVENTION

An antenna is a transducer that converts radio frequency electric energy to electromagnetic waves that are then radiated into space. The electric field determines the polarization or orientation of the radio wave. The polarization of an antenna in a given direction is the polarization of the wave radiated by the antenna. Most antennas are oriented to produce linear polarization (e.g., horizontal or vertical polarization). A linear polarized antenna radiates only in one plane containing the direction of propagation. If one station transmits a vertically polarized signal and a receiving station is using a horizontally polarized antenna, this will result in a weak signal at the receiver. Circular polarization allows an antenna to receive and transmit horizontal and vertical polarizations as well as every angle between horizontal and vertical. In circular polarization the electric field vector rotates with circular motion about the direction of propagation, making one full turn for each RF cycle. Thus, no matter what polarization the receiving station is using, the signal will come in at the same intensity.

Circular polarization provides improved signal to noise ratio since most noise sources are linearly polarized. Also, multipath interference is reduced as reflections of circularly polarized transmissions reverse polarization and are not received. Only multipath reflections with an even number of reflections are restored to the correct polarization and received.

Conventional antennas for wireless communications systems typically use vertical linear polarization as the reference or basis polarization characteristic of both transmit and receive base station antennas and wireless phone antennas. These antennas have drawbacks since linear polarization systems are susceptible to relatively poor performance due to multipath fading and other factors. Furthermore, vertical polarization often causes significant problems with hand-held antenna tilt. The vertical polarized signal received by the hand-held device is rarely vertical due to normal transmission fluctuations. The amount of tilt of the device varies with the particular operator and the conditions and environment. Losses due to antenna position and the received signal polarization angle mismatch can be significant in conventional hand-held wireless devices. These and other problems can result in distortion, cancellation, and loss of signal strength.

A further drawback of conventional circular polarization antennas is that they are typically designed to transmit narrow band signals. The antennas thus cannot be used in spread spectrum transmissions which use broader bandwidths. Other drawbacks include the size and weight of conventional antennas which make them unattractive for consumer handheld devices. Furthermore, conventional circular polarized transmitters typically use single ended unbalanced outputs that are matched to drive single ended balanced antennas, which results in power and transmission inefficiencies.

SUMMARY OF THE INVENTION

An antenna system for a wireless communication system is disclosed. The system generally comprises an antenna configured to receive and transmit circular polarized transmissions and a drive system. The drive system is operable to produce at least two outputs having generally the same amplitude. Each output is coupled to a different portion of the antenna. A phase difference is created between the outputs that is approximately matched to the antenna so as to create a desired polarity.

The antenna may comprise, for example, one or more patch antennas, dipole antennas, monopole antennas, helical antennas, horn antennas, slot antennas, fractal antennas, or spiral antennas. The system may further include a controller operable to switch the outputs between clockwise and counterclockwise transmissions to allow for simultaneous operation of two subsystems.

The drive system may have two or more outputs that are phase related to produce, in combination with the antenna, the desired polarization effect. The drive system may include two outputs having approximately ninety degrees of relative phase difference, for example.

In another aspect of the invention, a wireless communication device generally comprises an antenna configured to receive and transmit circular polarized transmissions in a spread spectrum system and a drive system. The drive system is operable to produce at least two outputs having generally the same amplitude and a phase difference relative to one another. Each output is coupled to a different portion of the antenna.

In yet another aspect of the invention, an antenna system for a wireless system generally comprises an antenna configured to receive and transmit circular polarized transmissions and a drive system. The antenna includes dual balanced feedpoints. The drive system is operable to produce a dual balanced output to drive the dual balanced feedpoints of the antenna.

The above is a brief description of some deficiencies in the prior art and advantages of the present invention. Other features, advantages, and embodiments of the invention will be apparent to those skilled in the art from the following description, drawings, and claims.

BRIEF DESCRIPTION OF THE DRAWINGS

Corresponding reference characters indicate corresponding parts throughout the several views of the drawings.

DETAILED DESCRIPTION OF THE INVENTION

The following description is presented to enable one of ordinary skill in the art to make and use the invention. Descriptions of specific embodiments and applications are provided only as examples and various modifications will be readily apparent to those skilled in the art. The general principles described herein may be applied to other embodiments and applications without departing from the scope of the invention. Thus, the present invention is not to be limited to the embodiments shown, but is to be accorded the widest scope consistent with the principles and features described herein. For purpose of clarity, details relating to technical material that is known in the technical fields related to the invention have not been described in detail.

Figure 1:
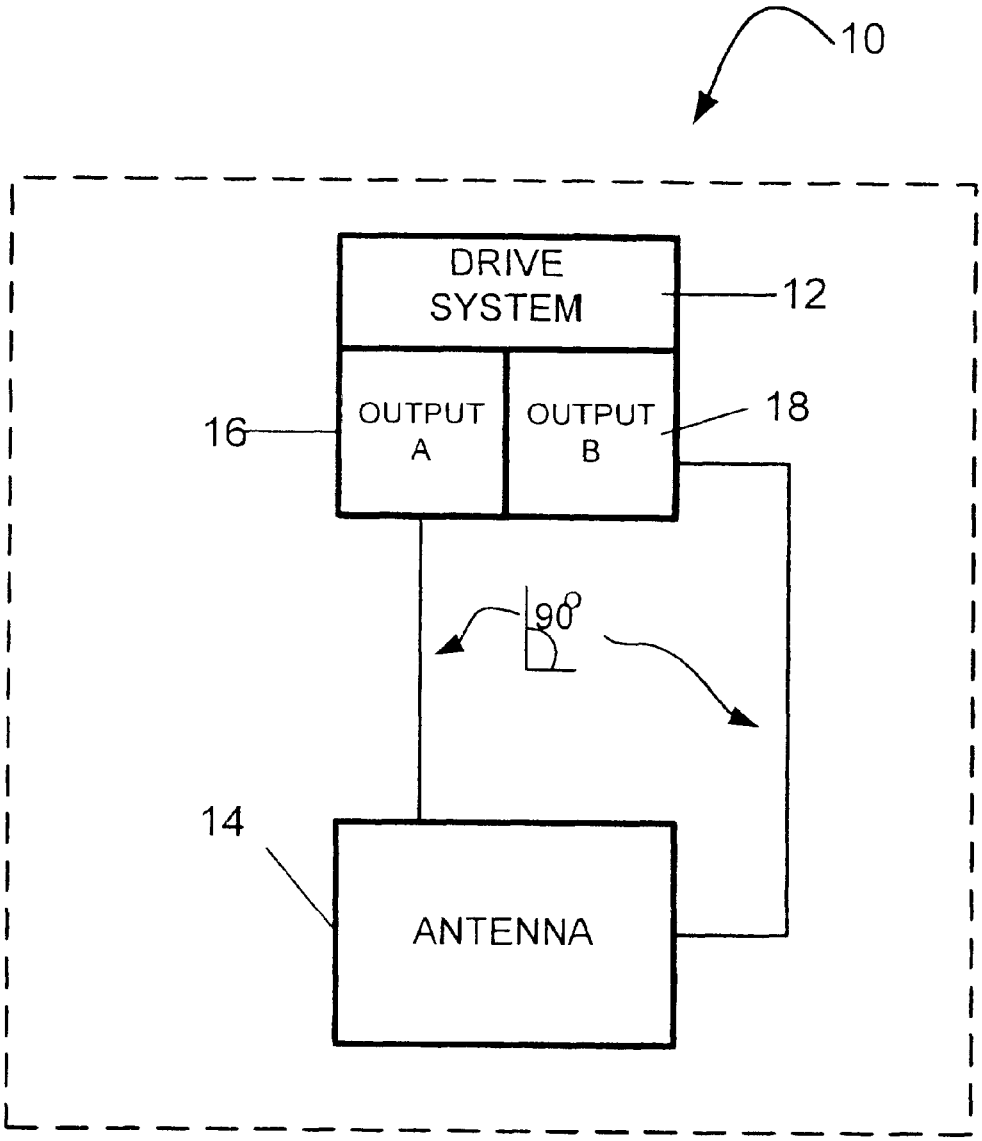
FIG. 1 is a block diagram illustrating a circular polarization antenna system of the present invention.

Referring now to the drawings, and first to FIG. 1, an antenna system of the present invention is shown and generally indicated at 10. The system includes a circular polarization drive system 12 that provides complementary outputs of a transmission signal which are used to drive an antenna 14. The drive system 12 preferably provides dual balanced outputs that are used to drive dual balanced feedpoints of the antenna. The two outputs 16, 18 (output A, output B) are phased in a 90 degree relationship to one another and drive separate portions of the antenna 14. It is to be understood that more than two outputs and other relative phase and placement relationships may be used to created the desired polarization. In order to provide circular polarization, two opposed polarization antennas or antenna elements are needed. As described below, the antenna 14 may include two separate antenna elements or a single antenna structure.

Figure 2:
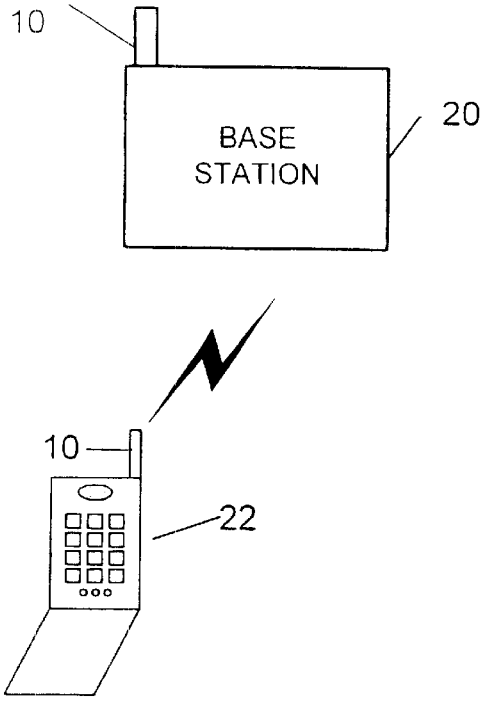
FIG. 2 is a schematic illustrating a wireless phone and base station utilizing the antenna system of FIG. 1.

The system 10 of the present invention may be used in wireless communication products such as a telephone as shown in FIG. 2. The system may be used in a device operating in the 1.5–6.0 GHz frequency band, for example. The telephone may be, for example, a cordless phone or a cellular phone. The cordless phone comprises a base station 20 and a phone handset 22. The base station 20 includes a standard phone jack go that it can be connected by wire to a public switch telephone network (PSTN). The handset 22 communicates with the base station 20 by low-power radio. The antenna system 10 may be located in one or both of the base station 20 and handset 22. The telephone system may also include a repeater such as described in U.S. patent application Ser. No. 09/678,458 filed Oct. 3, 2000, by H. Stephen Berger, and entitled HANDSET REPEATER FOR WIRELESS COMMUNICATION SYSTEMS, which is incorporated herein by reference in its entirety. The repeater may include the antenna system 10 of the present invention.

The antenna system 10 may also be used in cellular phones in which signals are transmitted from a mobile handset to a base station transceiver (not shown). A geographic region for cellular phone usage is divided into cells, each cell having a base station transceiver which transmits data via a radio link to a cellular phone located within a geographic region. Either one or both of the cellular phone and base station may include the antenna system 10 of FIG. 1.

Figure 3:
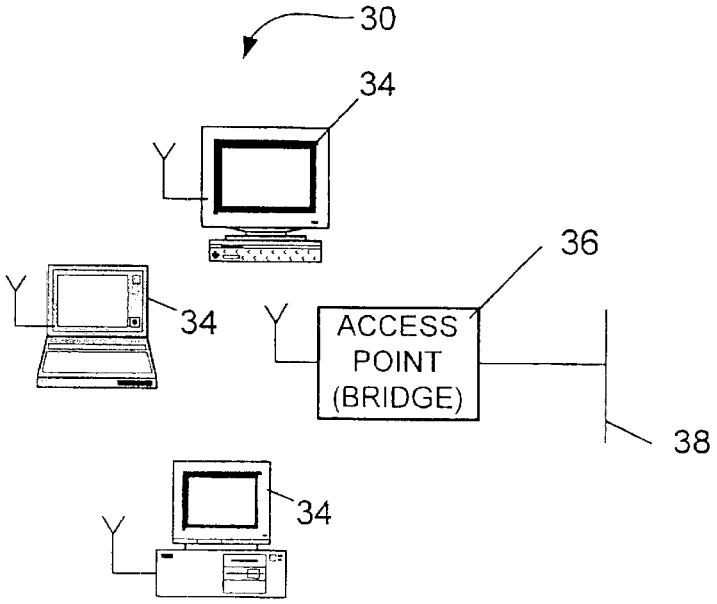
FIG. 3 is a schematic illustrating a wireless LAN system utilizing the antenna system of FIG. 1.

The antenna system 10 of the present invention may also be implemented in a wireless LAN (Local Area Network) 30, as shown in FIG. 3. The wireless LAN system 30 includes a plurality of network devices 34 each having a NIC (Network Interface Card) which interfaces the device with the wireless network through an access point (bridge) 36. The access point 36 interfaces the wireless network with a wired network 38. The access point 36 and each device 34 preferably include the antenna system 10 shown in FIG. 1.

The antenna system 10 may also be used in other devices such as wireless headsets, web appliances, microphones (including directional microphones), and hearing aids (used in combination with directional microphones).

The antenna system 10 is preferably configured to operate in spread spectrum systems. As well known by those skilled in the art, a spread spectrum communication system takes an information signal and spreads it in frequency until it occupies a much larger bandwidth than the original information signal. Two common spread spectrum modulation techniques are frequency hopping (FH) spread spectrum and direct sequence (DS) spread spectrum. The antenna system 10 is configured to match broadband spread spectrum signals so that the wireless device utilizing the antenna system can operate in systems using spread spectrum transmissions.

Referring again to FIG. 1, the system 10 includes antenna 14 operable to transmit and receive circular polarization transmission. As previously discussed, circular polarization provides advantages over linear polarization, such as reduced interference and improved transmission characteristics in communication devices. Furthermore, power efficiency is improved by the use of a dual output to drive the antenna 14. Conventional devices utilize only a single ended output to drive an antenna. The use of two outputs 16, 18 to drive the antenna 14 results in efficient radiation of more of the transmission power. Thus, battery life is improved and/or transmission distance is enhanced. The complementary outputs 16, 18 are preferably phased in a 90 degree relationship. By driving the two radiating elements 90 degrees out of phase from one another, spatial diversity is improved, thus reducing the effect of nulls in the transmission environment.

Figure 4A:
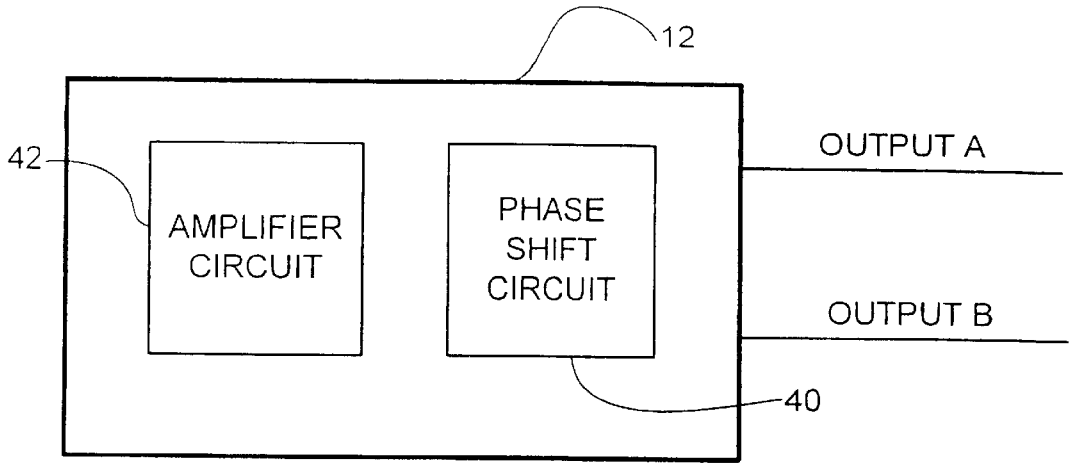
FIG. 4A is a block diagram of one embodiment of a drive system of the antenna system of FIG. 1.

The drive system 12 may include, for example, a phase shift circuit 40 and an amplifier circuit 42, as shown in FIG. 4A. The phase shift circuit provides a first signal to output A and a second signal to output B, which is 90 degrees out of phase and approximately equal in magnitude to the first signal. The amplifier 42 may be one available from Minicircuits of Brooklyn, N.Y. under the trade name Minicircuits Broadband Monolithic Amplifiers, model number ERA-xxxx, for example.

Figure 4B:
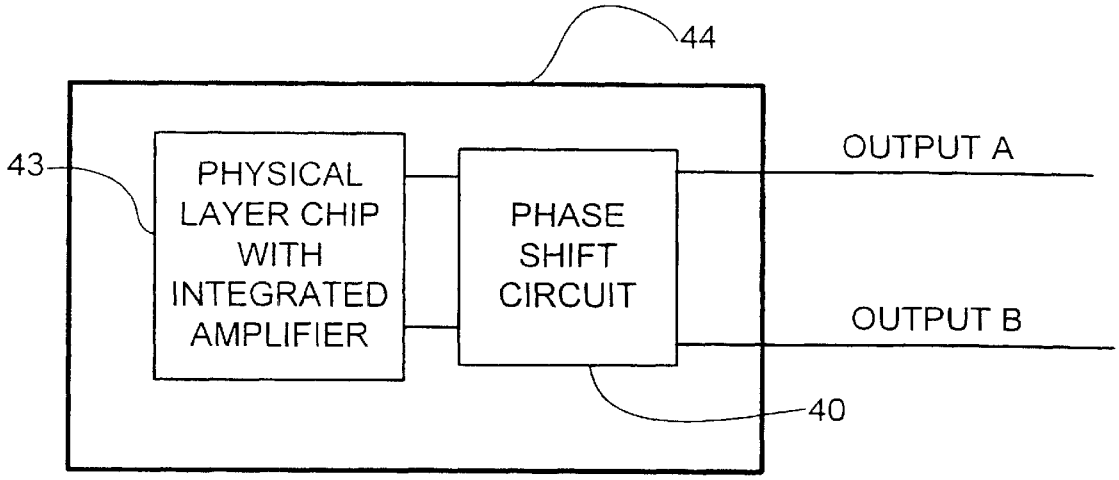
FIG. 4B is a block diagram of a second embodiment of the drive system of FIG. 4A.

FIG. 4B illustrates a second embodiment of the drive system of FIG. 1. The drive system 44 includes the phase shift circuit 40 and an amplifier 43 which is integrated into a physical layer chip (referred to as a layer 1 chip). Dual outputs drive the phase shift circuit 40, which may be a 90 degree BALUN (Balanced to Unbalanced Circuit), for example. The outputs of the BALUN have a relative phase offset which, when matched with the intended antenna creates the desired polarization. A preferred embodiment includes an integrated amplifier, transmitter, and receiver with discrete or printed circuit board phase shift circuitry providing the relative phase offset for the desired polarization. One example of an integrated amplifier, transmitter, and receiver which may be used is a Level 1 810 Transceiver chip, available from Level One of Sacramento. The BALUN phase shift circuit may be a device having a PCB (printed circuit board) layout, such as available from Minicircuits.

Figure 5:
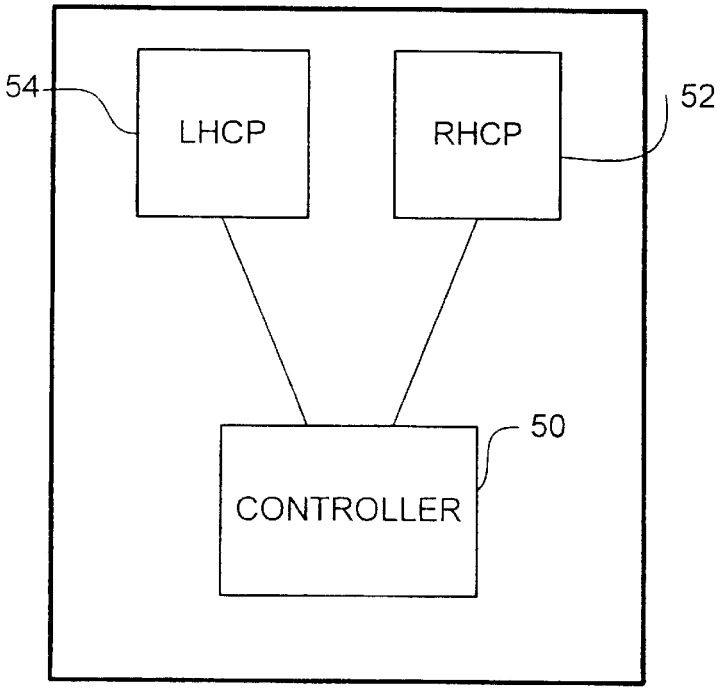
FIG. 5 is a block diagram illustrating left handed and right handed circular polarization subsystems and a controller operable to switch between the two subsystems.

The system 10 may also provide for multiple simultaneous transmissions, since clockwise polarized and counterclockwise polarized transmission are relatively invisible to each other. The system thus allows for simultaneous operation of multiple subsystems. A signal that rotates clockwise looking in the direction of propagation is known as right handed circular polarization. A signal that rotates counterclockwise is known as left handed circular polarization. A controller 50 is used to dynamically switch the complementary outputs 16, 18 of the drive system 12 to allow the device to utilize either clockwise or counterclockwise transmissions (FIG. 5). The controller 50 is used to switch the phase relationship between the outputs such that the device may operate in a clockwise transmission (i.e., right handed circular polarization (RHCP)) subsystem or a counterclockwise (i.e., left handed circular polarization (LHCP)) subsystem. This allows the system to have two simultaneously operating subsystems.

Figure 4C:
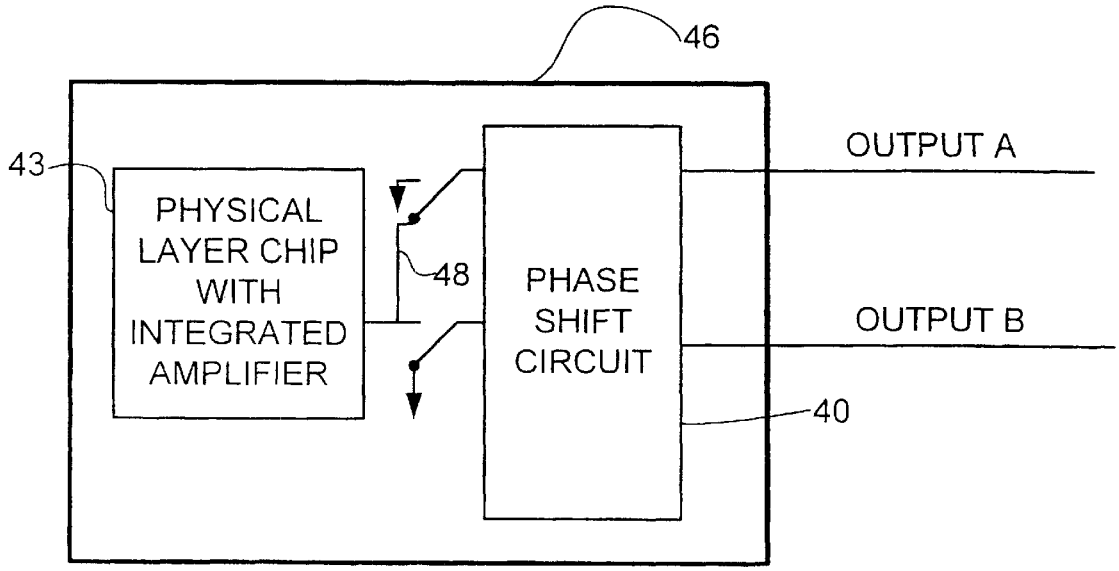
FIG. 4C is a block diagram of a third embodiment of the drive system of FIG. 4A.

FIG. 4C illustrates a third embodiment for the drive system of FIG. 1. The drive system 46 includes the phase shift circuit 40 and the physical layer chip with integrated amplifier 43 as described above with respect to the drive system 44 of FIG. 4B. The drive system 46 further includes a switch 48 inserted between the physical layer chip and amplifier 43 and the phase shift circuit 40. When the switch position is changed, the inputs to the phase shift circuit 40 are reversed resulting in a right hand polarized signal being changed to a left hand polarized signal (or a left hand polarized signal being changed to a right hand polarized signal). The switch 48 may also be located after the phase shift circuit or inserted between the components of drive system 12 shown in FIG. 4A. Any of these switch placements will provide polarization control. A preferred embodiment includes an integrated amplifier, transmitter, and receiver with an integrated phase shifter and switch providing the phase shift for the desired polarization. The time and control of the integrated phase shifter and switch is based upon signal strength, integrity, polarization, and environment. The RF switches may be PIN diode switches, for example.

As discussed above, the antenna 14 may comprise a single antenna device or multiple antenna elements. The antenna 14 may comprise, for example, patch antennas, dipole, antenna 102 (FIG. 9*a*), monopole antenna, spiral antenna 80 (FIG. 8), helical antenna 104 (FIG. 9*b*), horn antenna 106 (FIG. 9*c*), slot antenna 108 (FIG. 9*d*), fractal antenna 110 (FIG. 9*e*), or any other antenna or combination of antenna elements that provide circular polarization. One preferred antenna structure comprises two monopole antennas positioned orthogonally with a switching circuit creating the desired polarization. The antenna may have any shape that will result in a desired beam width pattern. The antenna 14 preferably includes dual balanced feedpoints.

Figure 6:
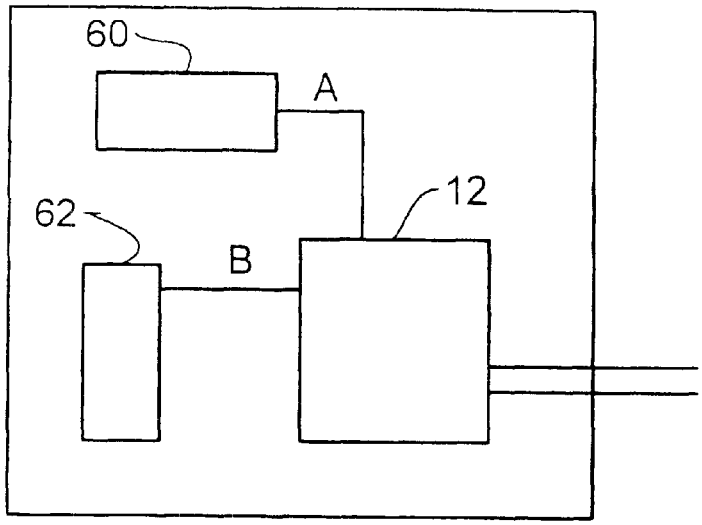
FIG. 6 is a schematic illustrating an antenna of the antenna system of FIG. 1 consisting of two patch antennas.

FIG. 6 illustrates one embodiment of the present invention. The complimentary outputs A, B of the antenna 14 drive two patch antennas 60, 62, respectively. The patch antennas 60, 62 are preferably positioned to minimize the likelihood of interference from a user's head or hand and placed to provide spatial diversity, thus improving transmission resistance to reflective nulls. The patch antennas 60, 62 include a dielectric substrate mounted on a metallic ground plate with a resonant metallic patch (radiating element) affixed to the opposite side of the substrate, as is well known by those skilled in the art. Circular polarization is obtained by exciting two orthogonal modes with a 90 degree time-phase difference between them. The two surface mount antennas 60, 62 are disposed such that the longitudinal direction of their base members are perpendicular to each other so that their planes of polarization (i.e., planes formed by the direction of the electric field and the direction the wave proceeds) of the emitted waves are perpendicular to each other in the direction normal to the mounting substrate. Signals transferred from the two antennas have a phase shift of 90 degrees. The patch antennas are preferably physically shaped to have a resonance band matched to the transmission bandwidth for operation in spread spectrum systems.

Figure 7:
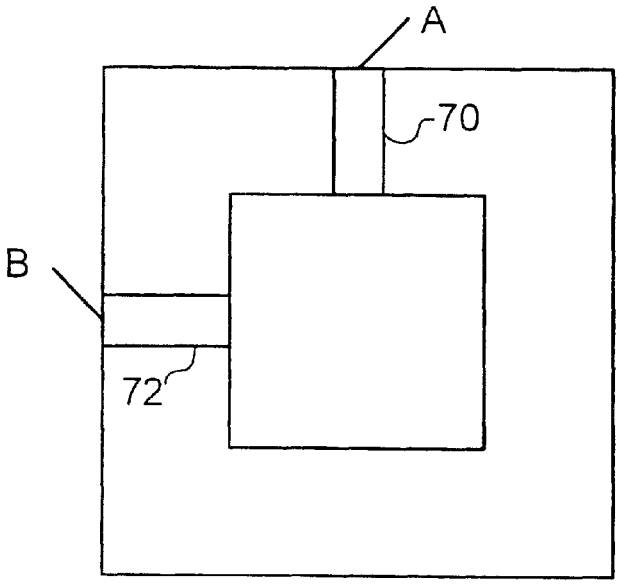
FIG. 7 is a schematic illustrating an antenna of the antenna system of FIG. 1 consisting of a patch antenna.

FIG. 7 illustrates a square patch antenna having two edge elements 70, 72. The patch antenna is fed at two adjacent edge elements with generally equal amplitude signals that are separated in phase by 90 degrees. It is to be understood that other dual feed arrangements may be used to obtain circular polarization in patch antennas of other shapes, without departing from the scope of the invention. Also, as previously discussed, more than two outputs may be provided and relative phase and relationships other than those described herein may be used to created a desired polarization.

Figure 8:
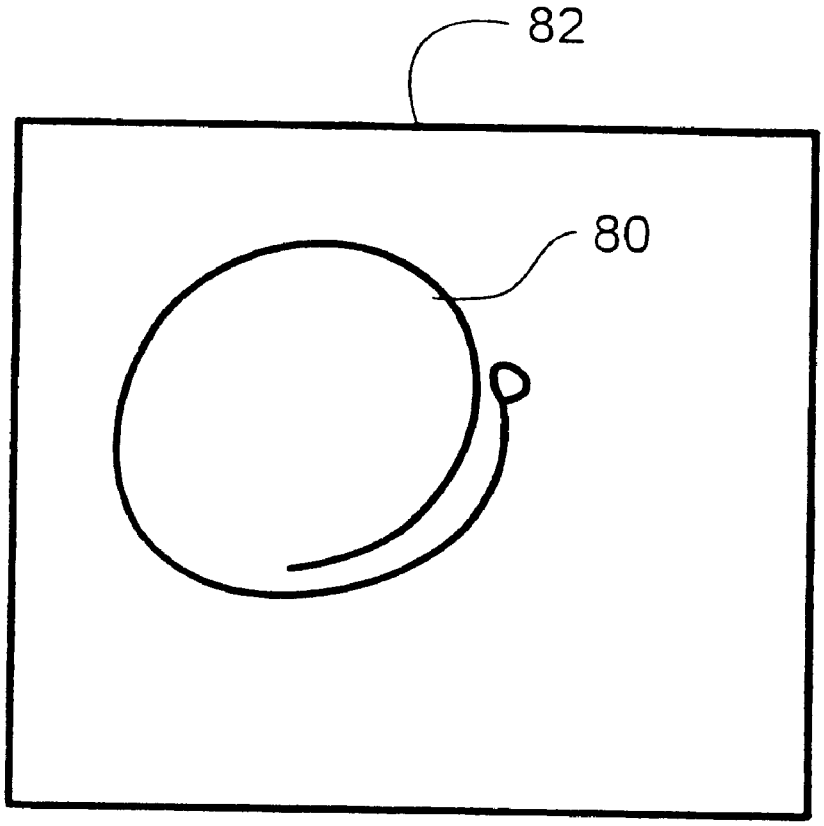
FIG. 8 is a schematic illustrating an antenna of the antenna system of FIG. 1 consisting of a spiral antenna.
Figure 9A:
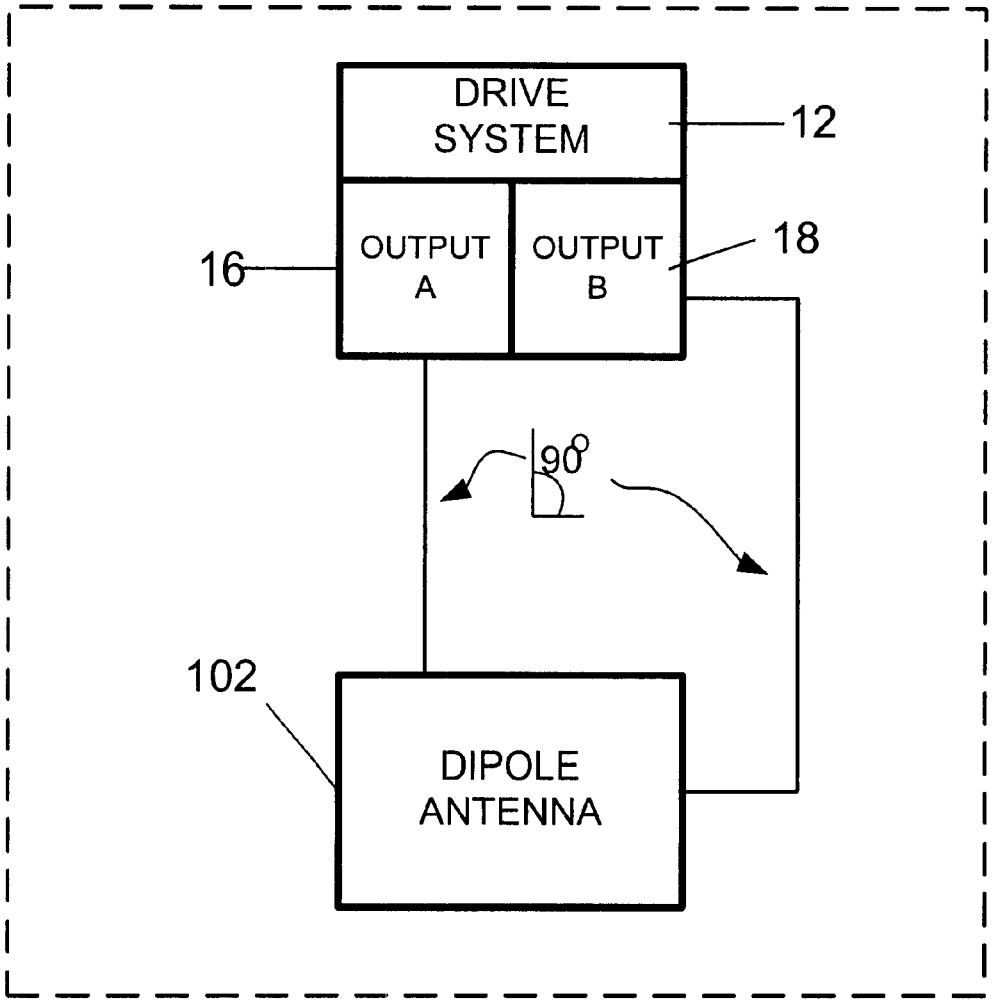
FIG. 9*a* is a block diagram of the antenna system of FIG. 1 utilizing a dipole antenna.
Figure 9B:
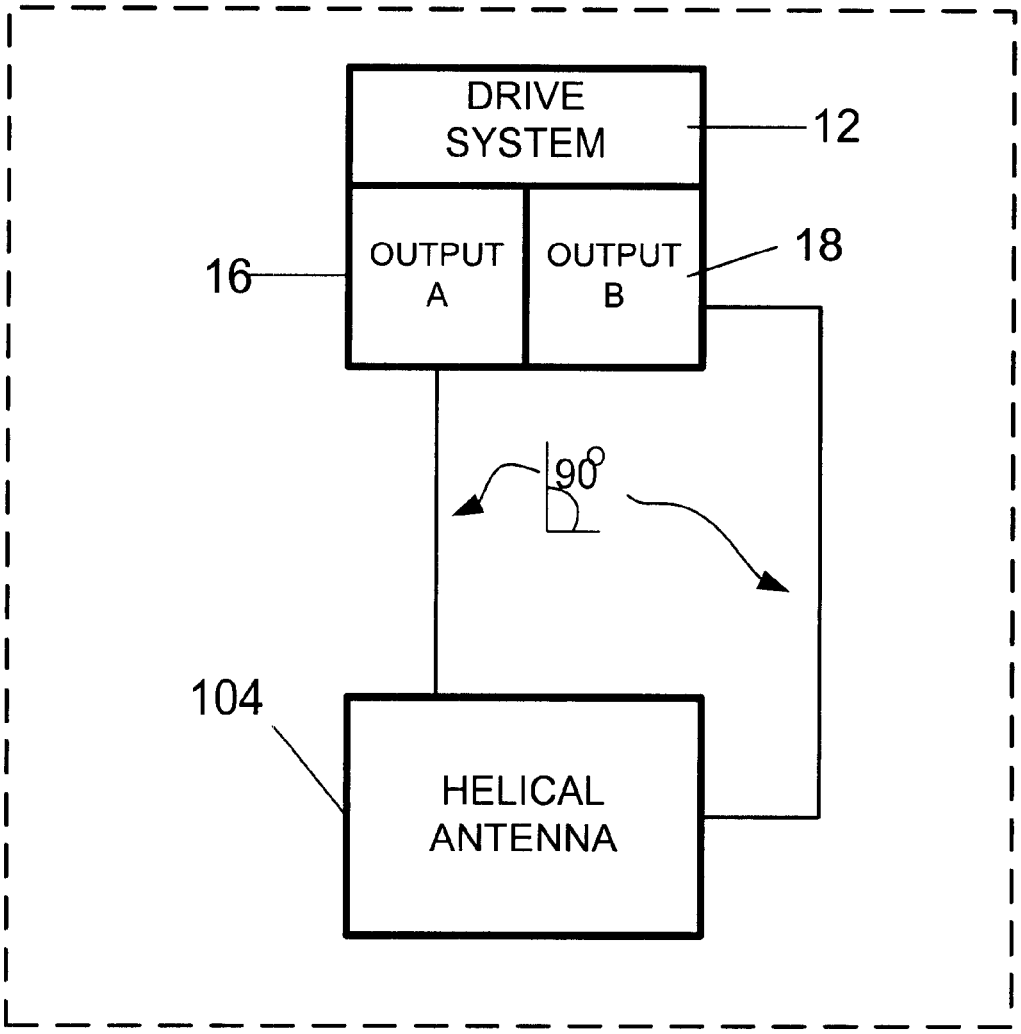
FIG. 9*b* is a block diagram of the antenna system of FIG. 1 utilizing a helical antenna.
Figure 9C:
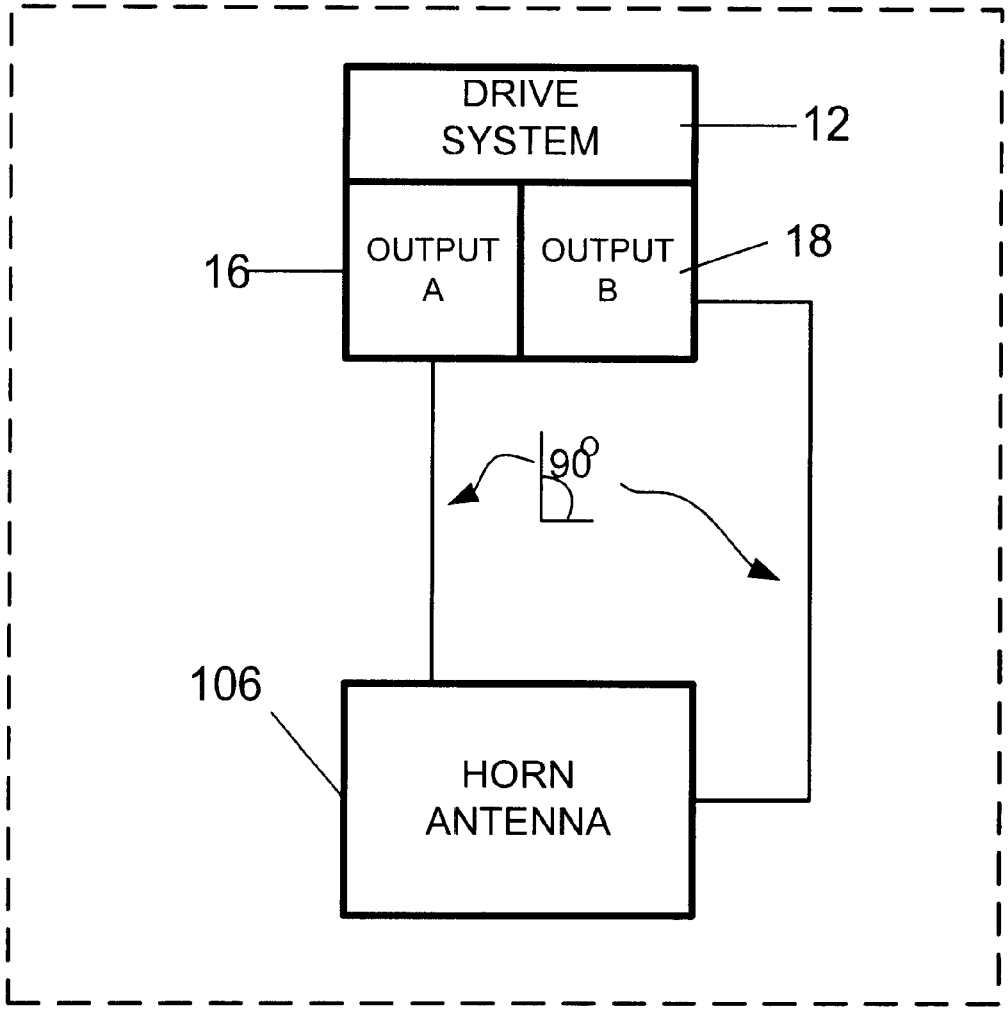
FIG. 9*c* is a block diagram of the antenna system of FIG. 1 utilizing a horn antenna.
Figure 9D:
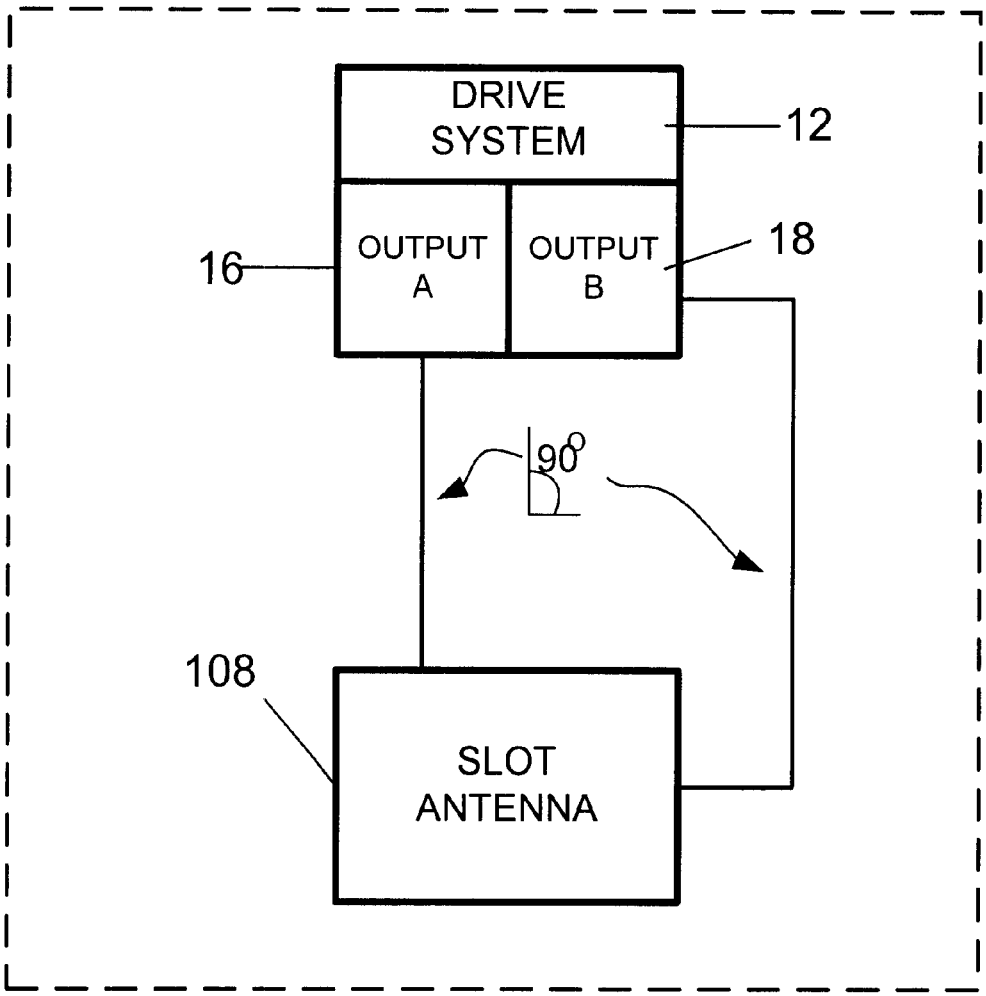
FIG. 9*d* is a block diagram of the antenna system of FIG. 1 utilizing a slot antenna.
Figure 9E:
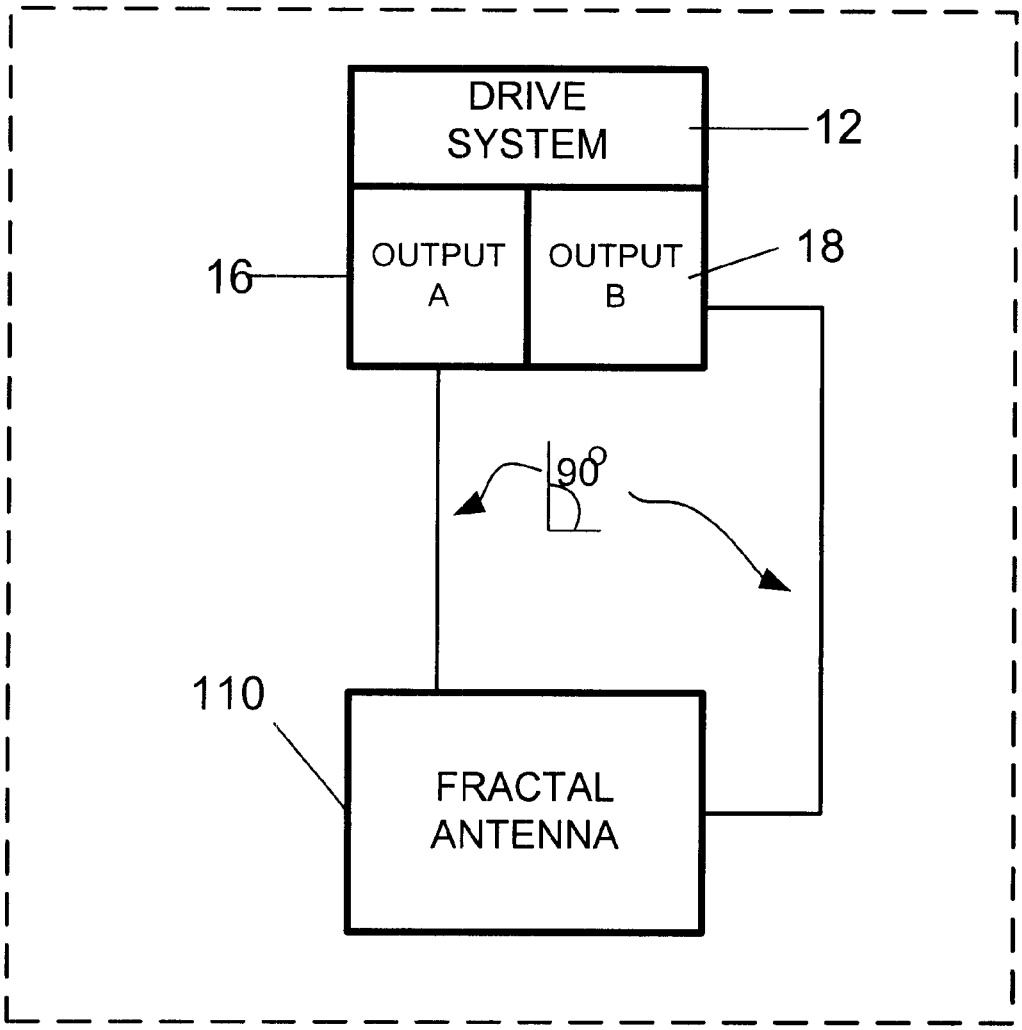
FIG. 9*e* is a block diagram of the antenna system of FIG. 1 utilizing a fractal antenna.

The antenna 14 may also comprise a spiral antenna 80, as shown in FIG. 8. The spiral antenna 80 may be formed, for example, of a layer of conductive material deposited in a spiral pattern on a printed circuit board 82. The spiral may also be formed from a wire shaped in a spiral pattern and affixed to the printed circuit board 82. Circular polarization is achieved by forming the spiral antenna such that it makes slightly more than one turn and the spiral's length is longer than the wavelength of operation.

The antenna system 10 may comprise other dual polarized radiators such as those comprising a first dipole element and a second dipole element positioned orthogonal to one another.

The antenna 14 is designed for integration into the wireless device so that the antenna element can utilize other electrical components of the device. The elements of the antenna system 10 are preferably configured to conform to the shape of the device and disposed such that their proximity to other components creates a capacitive loading, which electronically lengthens the elements. This capacitive loading allows the use of physically smaller elements than would otherwise be possible. Furthermore, this physical arrangement allows for optimization of the radiated pattern to the intended use environment.

As can be observed from the foregoing, the system 10 of the present invention provides numerous advantages over conventional systems. The dual feed elements from a single drive system provide spatial diversity, improved power utilization, increased range, improved multipath performance, and reduced effect from reflected nulls. Furthermore, the system 10 allows for an internal antenna which improves the appearance of a product and provides a compact wireless device.

Although the present invention has been described in accordance with the embodiments shown, one of ordinary skill in the art will readily recognize that there could be variations made to the embodiments without departing from the scope of the present invention. Accordingly, it is intended that all matter contained in the above description and shown in the accompanying drawings shall be interpreted as illustrative and not in a limiting sense.

What is claimed is:

1. An antenna system for a wireless communication system, comprising:

an antenna configured to receive and transmit circular polarized transmissions in a spread spectrum system;

a drive system operable to produce at least two outputs having generally the same amplitude and a phase difference relative to one another, each output being coupled to a different portion of the antenna; and a controller operable to dynamically switch the outputs between clockwise and counterclockwise transmissions to define two subsystems configured for simultaneous operation.

2. The system of claim 1 wherein the antenna is formed from two patch antennas.

3. The system of claim 2 wherein each of the patch antennas is mounted on a substrate positioned generally perpendicular to the other patch antenna.

4. The system of claim 1 wherein the antenna comprises a dipole antenna.

5. The system of claim 1 wherein the antenna comprises two monopole antennas.

6. The system of claim 1 wherein the antenna comprises a spiral antenna.

7. The system of claim 1 wherein the antenna comprises a helical antenna.

8. The system of claim 1 wherein the antenna comprises a horn antenna.

9. The system of claim 1 wherein the antenna comprises a slot antenna.

10. The system of claim 1 wherein the antenna comprises a fractal antenna.

11. The system of claim 1 wherein the phase difference is approximately ninety degrees.

12. The system of claim 1 wherein the outputs of the drive system are dual balanced outputs.

13. The system of claim 12 wherein the antenna comprises dual balanced feedpoints.

14. The system of claim 1 wherein the drive system comprises a phase circuit.

15. The system of claim 14 wherein the drive system comprises an amplifier.

16. The system of claim 15 wherein the amplifier is integrated in a physical layer chip.

17. The system of claim 14 wherein the phase circuit is a balanced to unbalanced circuit.

18. The system of claim 1 further comprising a wireless LAN system, the antennas system being located within a wireless device in the LAN system.

19. A wireless communication device comprising:

an antenna configured to receive and transmit circular polarized transmissions in a spread spectrum system;

a drive system operable to produce at least two outputs having generally the same amplitude and a phase difference relative to one another, each output being coupled to a different portion of the antenna; and a controller operable to dynamically switch the outputs between clockwise and counterclockwise transmissions to define two subsystems configured for simultaneous operation.

20. The device of claim 19 wherein the device is a wireless telephone handset.

21. The device of claim 19 wherein the device is a repeater.

22. The device of claim 19 wherein the device is a base station.

23. The device of claim 19 wherein the device is a cellular phone.

24. The device of claim 19 wherein the device is operable to communicate within a wireless LAN system.

25. The device of claim 19 wherein the antenna is disposed internal to the device.

26. The device of claim 19 wherein the antenna and drive system are disposed within the device to create a capacitive loading in conjunction with other electrical components within the device.

27. The device of claim 19 wherein the device is configured for use in a 1.5–6.0 GHz frequency band.

28. The device of claim 19 wherein the device is a web appliance.

29. The device of claim 19 wherein the device is a directional microphone.

30. The device of claim 19 wherein the device is a hearing aid.

31. The system of claim 1 wherein the antenna is configured to operate in a system utilizing frequency hopping spread spectrum.

32. The system of claim 1 wherein the antenna is configured to operate in a system utilizing direct sequence spread spectrum.

33. An antenna system for a wireless communication system, comprising:

an antenna configured to receive and transmit circular polarized transmissions, the antenna having dual balanced feedpoints;

a drive system operable to produce dual balanced outputs to drive said dual balanced feedpoints of the antenna;

wherein the drive system further comprises a phase shift circuit, wherein said phase shift circuit is a ninety degree balanced to unbalanced circuit; and further wherein the drive circuit further comprises a switch operable to reverse inputs to the phase shift circuit to change the polarized signal from left handed to right handed or from right handed to left handed.

* * * * *